US005805064A

United States Patent [19]

Yorkey

[11] Patent Number: 5,805,064

[45] Date of Patent: Sep. 8, 1998

[54] SECURITY SYSTEM

[76] Inventor: David Yorkey, 5531 Squires Dr., The Colony, Tex. 75056

[21] Appl. No.: 777,800

[22] Filed: Dec. 30, 1996

Related U.S. Application Data

[63] Continuation of Ser. No. 511,693, Aug. 4, 1995, abandoned.

[51] Int. Cl.[6] ..... G08B 13/00

[52] U.S. Cl. ..... 340/550; 340/541; 340/825.22; 340/825.32

[58] Field of Search ..... 340/506, 559, 340/541, 825.22, 825.31, 825.32, 825.37, 825.34, 528; 345/33, 34, 59

[56] References Cited

U.S. PATENT DOCUMENTS

| | | | |
|---|---|---|---|
| 4,667,183 | 5/1987 | Gaudio | 340/528 |
| 4,797,663 | 1/1989 | Rios | 340/691 |
| 4,821,027 | 4/1989 | Mallory et al. | 340/506 |
| 4,831,374 | 5/1989 | Masel | 340/825.31 |
| 4,845,487 | 7/1989 | Frantz et al. | 340/679 |
| 4,931,769 | 6/1990 | Phillips et al. | 340/506 |
| 5,047,748 | 9/1991 | Trickle | 340/542 |
| 5,319,698 | 6/1994 | Glidewell et al. | 379/39 |

*Primary Examiner*—Jeffery Hofsass
*Assistant Examiner*—Benjamin C. Lee
*Attorney, Agent, or Firm*—Lock Purnell; Rain Harrell

[57] ABSTRACT

A security system control system that arms a system independent of a particular sequence of key inputs. A security system control system with a pseudo alphanumeric display to display system status and to prompt the user to input data to effectuate a desired result.

4 Claims, 8 Drawing Sheets

| ZONE IDENTIFICATION | |
|---|---|
| 01 | FRONT DOOR |
| 02 | GARAGE DOOR |
| 03 | DEN |
| 04 | MASTER BEDROOM |
| 05 | |
| 06 | |
| 07 | |
| 08 | |

F-FIRE PANIC
P-POLICE PANIC
A-MEDICAL PANIC
L-LINE CUT (OPTIONAL)
H-HOSTAGE (OPTIONAL)
O-NO ALARM IN MEMORY
CP-COMMUNICATION PROBLEM

SECURITY SYSTEM

RELATED APPLICATION

This application is a continuation of application Ser. No. 08/511,693 filed on Aug. 4, 1995, now abandoned.

This application is filed and copending with Design application Ser. No. 29/143,442.

FIELD OF THE INVENTION

This application relates to display and control systems for security systems.

BACKGROUND

Current security systems are generally controlled by a microprocessor to provide greater sophistication and flexibility. The control terminal for present security systems typically includes a keypad and a display, each controlled by a microprocessor. In order to have a system that is easier to operate, current systems have turned to alphanumeric displays and keypads. The alphanumeric input and output have made the systems more user friendly. An easier to use device has obvious advantages in the commercial market but is particularly important in the residential market, where the users may be less sophisticated and have less training in the operation of computerized systems. Unfortunately, the addition of alphanumeric displays and keypads comes at the cost of one and perhaps two additional microprocessors to drive the display and the keypad. The present invention provides for alphanumeric type output without the added cost of an alphanumeric display and the necessary microprocessor overhead to support a true alphanumeric display.

Many security systems today have met market resistance, or dissatisfaction, because of the difficulty or the complexity of their use. This is particularly true in the residential market where present systems have resulted in false alarms, or failure to detect an emergency caused by user error. In today's busy world, users do not have the time, or patience, to learn and remember the complexities of operating even simple functions on these systems. For example, in order to disarm a system, a predefined sequence of commands must be entered in a specific order within a predetermined time limit in order to avoid setting off an alarm. The complexity of these systems may also cause the user to misarm the system resulting in a false alarm. Such false alarms can cost the user money, time, aggravation and wastes valuable emergency personnel resources in the community. In addition, the complexity of setting a system may cause the user to fail to correctly arm the system, or to avoid arming the system, so that emergency situations are not detected, thus depriving the user of the benefits of a security system. Therefore, a system that does not require the user to memorize a series of sequences or to rely on a manual to arm, selectively arm, disarm and otherwise operate the system would be advantageous.

DESCRIPTION OF THE PREFERRED EMBODIMENT

The present invention relates to a security control system which has both hardware and software components. Before discussing the software components of the control system the hardware components of one embodiment of the invention is described.

Hardware

Figure 1:
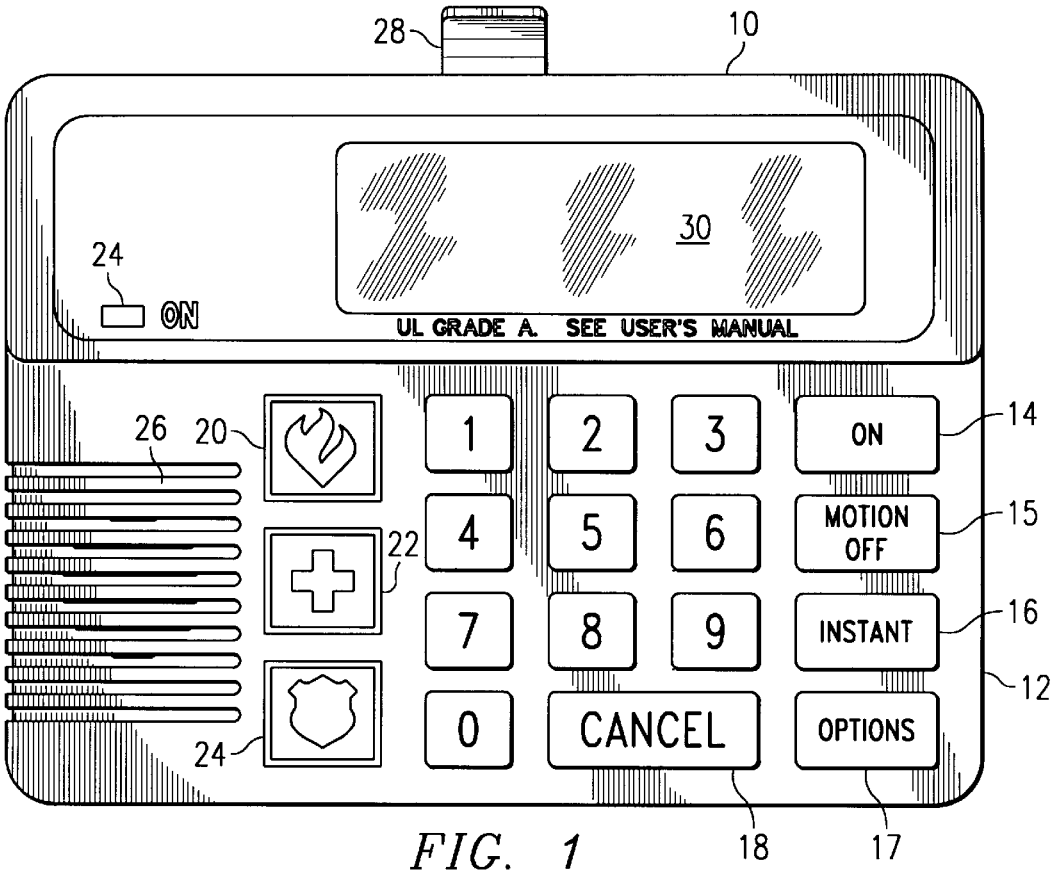
FIG. 1 is a drawing depicting the security system control panel.

FIG. 1 is an illustration of the security system control panel 10 of the present invention. The control panel includes a keypad 12 which further includes: a numeric set of ten (10) numeric keys for the numerals zero through nine (0–9) (these keys will be referenced herein by the respective numeral the key represents); function keys 14–18; and emergency keys 20, 22 and 24. The emergency keys 20, 22 and 24 are programmed to automatically dial emergency numbers for a fire station, an ambulance or hospital, and the police station, respectively, to inform them of an emergency. In the embodiment of the invention shown, the function keys are identified as [ON] 14, [MOTION OFF] 15, [INSTANT] 16, [OPTIONS] 17 and [CANCEL] 18.

Figures 3, 4:
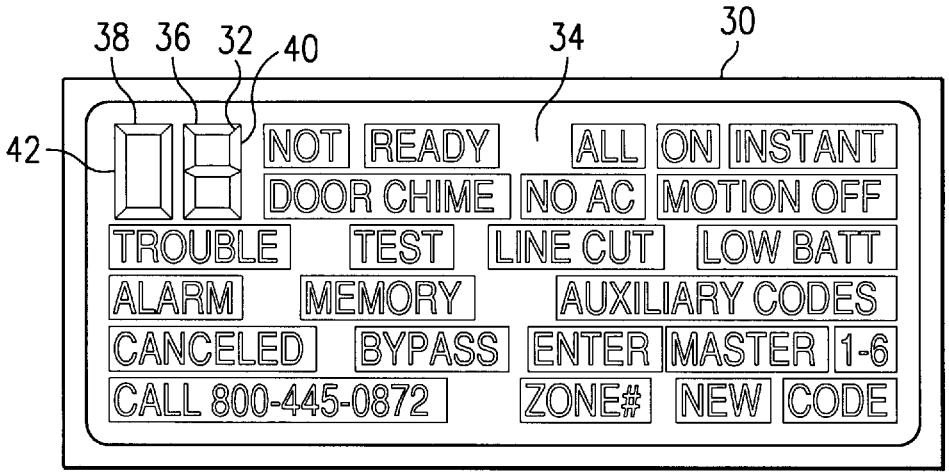
FIG. 3 is a number and text layout of the hybrid display output.
FIG. 4 is a retractable code menu sheet.

The control panel also includes an "ARMED" or "ON" indicator 24 and a annunciator 26 for audiblizing an alarm signal and providing audible feed back to the user. A light emitting diode (LED) would serve a suitable "ARMED" or "ON" indicator. A commercially available piazo crystal speaker, which can be driven by a standard oscillating circuit, or includes an oscillating circuit, would be suitable for this purpose. The control panel 10 also includes a tab 28 for a retractable code identification sheet to assist the user to identify zone codes which have been assigned to various sensors in the security system. An example of such a code sheet is illustrated in FIG. 4. The control panel 10 also includes a display 30 whose possible output is illustrated in FIG. 3 discussed below.

Figure 2:
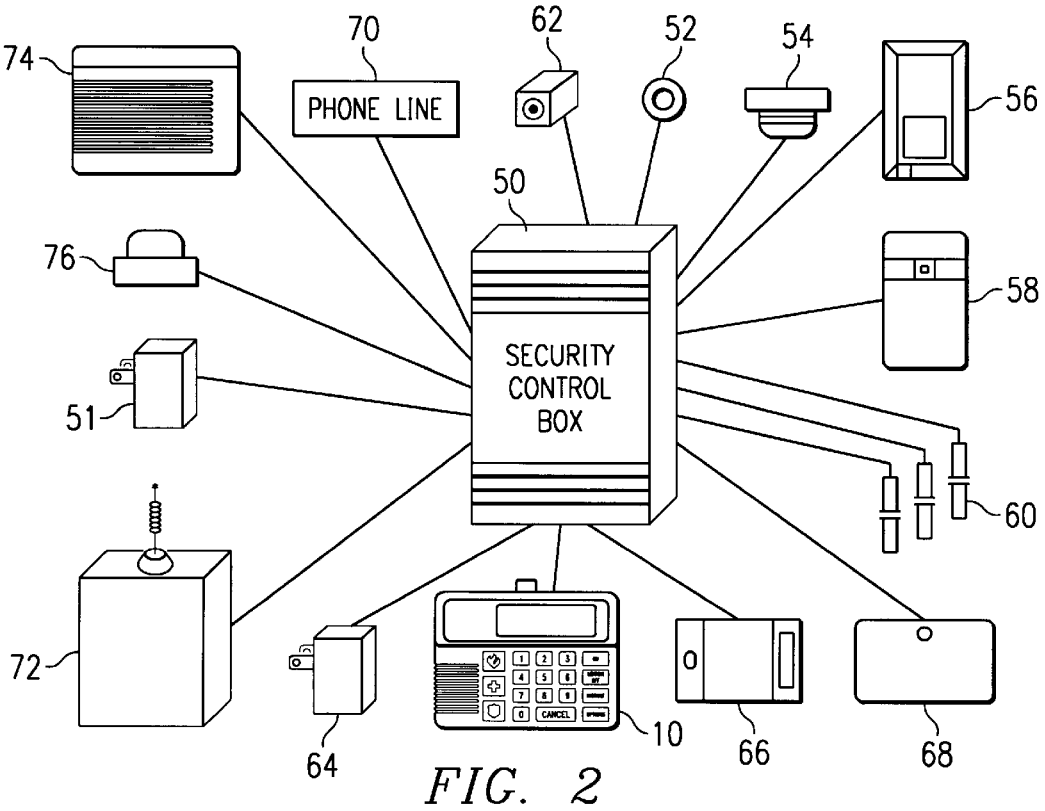
FIG. 2 is an illustrative drawing depicting a typical security system for which the control panel can be utilized.

FIG. 2 is an illustration of a security system showing a security control box 50 and the control panel 10. The security control box is connected to a power source through a transformer 51. The security control box 50 is connected an assortment of security sensor devices such as: heat sensors 52, smoke detectors 54, motion detectors 56, glass break sensors 58, door or window sensors 60. These sensors are commercially available. The security control box 50 may also be connected to a panic button 62 and an X-10 64 interface for turning on or off power supply to other devices such as lights inside or outside the building. The security control box 50 may also be connected to interface with a home automation system 66 or to a wireless interface or zone expander 68 which are in turn connected to additional security sensor devices similar or identical to those discussed above. The security control box 50 may also be connected to a telephone line 70 for making emergency calls. The security control box 50 may also be connected to a phone line backup system 72 in case the phone line is cut or goes dead. A cellular telephone or long-range radio system would be suitable for this purpose.

In addition to the phone line 70 several output devices can be connected to the security control box, such as sirens 74 or strobe lights 76. Finally, the control panel 10 of the security system is connected to the security control box as the user's primary interface with the system.

FIG. 3 is an illustration of one configuration that may be used for the possible outputs of the display 30. The preferred embodiment of the display 30 is a hybrid of a true alphanumeric code display 32 and a pseudo alphanumeric display 34. In the embodiment described herein, the code display 32 is capable of displaying alphanumerical codes in two places 36 and 38. In FIG. 3 the display is illustrated as "08" where "8" fills the first place 36 and "0" fills the second place 38. Each place consists of 7 separate segments 40. Each of these segments may be enabled by a separate input signal. One input signal may be used to enable a combination of segments for example 42. In the embodiment of the invention shown the code display output is designed to match the codes in the code identification sheet illustrated in FIG. 4.

The pseudo alphanumeric display section 34 of the display 30 includes a plurality of possible outputs to inform the user of system status and prompt the user during input. In the embodiment of the display 30 shown in FIG. 3, the alphanumeric display includes 24 outputs (beginning top left): "NOT", "READY", "ALL", "ON", "INSTANT", "DOOR CHIME", "NO AC", "MOTION OFF", "TROUBLE", "TEST", "LINE CUT", "LOW BATT", "ALARM", "MEMORY", "AUXILIARY CODES", "CANCELED", "BYPASS", "ENTER", "MASTER", "1–6", "CALL 800-445-0872", "ZONE#", "NEW", "CODE". Each of these outputs requires a single signal to display the output. Although each output appears alphanumeric to the user, each is in fact generated by a single one bit digital signal. A suitable display for the purposes of this invention is a liquid crystal display because of its low power usage and low cost.

Other embodiments of the present system may provide for different pseudo alphanumeric displays or hybrid displays.

Figure 5:
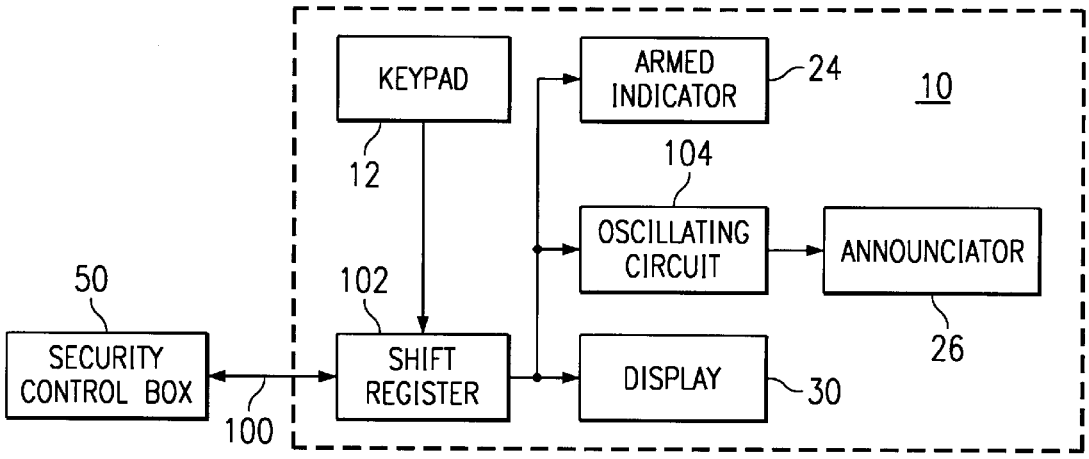
FIG. 5 is a circuit block diagram illustration of the electronic components of the control panel.

FIG. 5 is an illustration of the electronic components of the control panel 10. The control panel 10 is bidirectionally connected to the security control box 50 by a serial data line 100. Within the control panel 10, the serial connection 100 to the security control box 50 is connected to a shift register 102. The shift register 102 is also connected to the keypad 12 in order to receive the user's keypad entries and convert them to serial data to be sent to the security control box 50. The shift register 102 is also connected to the display 30 to display data received by the shift register 102 from the security control box 50.

For a true alphanumeric display a microcontroller, located either in the security control box 50 and/or in the control panel 10, would be necessary for converting the input from the security control panel 10 herein into data which could be received and displayed. Through the use of this invention, the user can receive information in an alphanumeric format without the software and hardware overhead of a true alphanumeric display system.

The shift register 102 is also connected to the annunciator 26 in the control panel 10 through an oscillating circuit 104. When the oscillating circuit 104 receives an enable signal, it generates a plurality of signals which causes the speaker 26 to annunciate unique tones. The purpose of this speaker 26 is to: (1) audibly confirm for the user that the user's input was received by the control panel 10, (2) inform the user that an invalid user input has been received, (3) inform the user that the emergency medical function key 22 has been pressed, (4) system fault annunciation (such as low battery, cut power, cut phone line, communication failure, sensor failure, etc.), (5) pre-alarm, system trigger warning tone, and (6) door chime. The type of tone annunciated depends on the pattern of the enable signals received by the oscillating circuit 104. For example, the tone for receiving data can be a short duration constant tone; invalid input may be a rapid cycled tone and a medical emergency may be a slower cycled tone.

The shift register 102 is also connected to the armed indicator 24 so that the indicator can be enabled when the system is armed.

Figure 6:
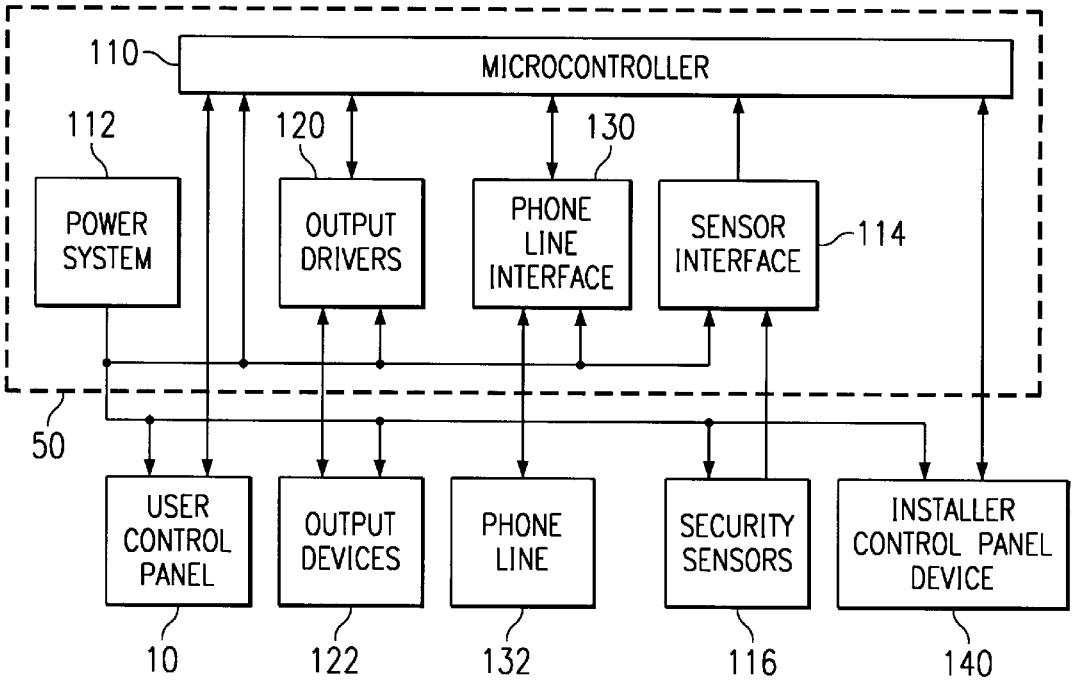
FIG. 6 is a block diagram of the system control box.

FIG. 6 is a block diagram of the major components of the security control box 50. The heart of the security control box is a microcontroller 110. The Intel 87C51 microcontroller is a suitable microcontroller, however other microcontrollers are available that would also be suitable. It is also possible to use a state logic device in place of the microcontroller in some embodiments of the invention. The microcontroller is powered by a power system 112. The power system 112 includes a transformer that may or may not be in the control box 50. In the preferred embodiment the power system 112 also supplies regulated power in the proper voltage and amperage for the components of the control box 50 and control panel 10, the sensors that require power input as described below. Although it is not shown in the figures, the power supply to certain sensors, such as the smoke detectors, may require interruption of the power supply in order to reset the device. In a preferred embodiment, the power system 112 also includes a backup battery or other backup power supply (not shown).

The microcontroller 110 is also connected to sensor interfaces 114 for converting signals from the sensors 116 into signals the microcontroller 110 can recognize. These sensors 116 are identified in FIG. 2 as references 52–60.

The microcontroller 110 is also connected to output drivers 120. These output drivers drive the output devices 122 when they receive an appropriate enable signal from the microcontroller 110. The output devices are identified in FIG. 2 as 64, 66, 68, 72, 74, & 76.

The microcontroller 110 is also connected to a telephone line interface 130 which enables the microcontroller to call and send messages over a telephone line 132. For example an emergency function key 20, 22 or 24 is depressed by a user, the microcontroller sends a message over a phone line 132 through the use of the phone line interface 130.

In addition to these connections, the microcontroller 110 is also bidirectionally connected to both the user control panel 10 and an installer control panel 140. These connections act as data buses that hold information to make it available to both the microprocessor 110 and the user control panel 10 or the installer control panel 140. The selection and configuration of the sensors, interfaces, output devices and drivers and other components, is well within the scope of someone reasonably skilled in the art of designing security control systems.

Software Operation

In the preferred embodiment of the invention, the software code which determines and controls the operation of the control panel is written in machine language and is embedded in the microcontroller 110 of the security control box shown in FIG. 6. FIGS. 7, 9, 10 & 11 illustrate the algorithms for three (3) major user input functions of the system: (1) alarm input function, (2) an arm/disarm input function, and (3) an option input function.

Figure 7:
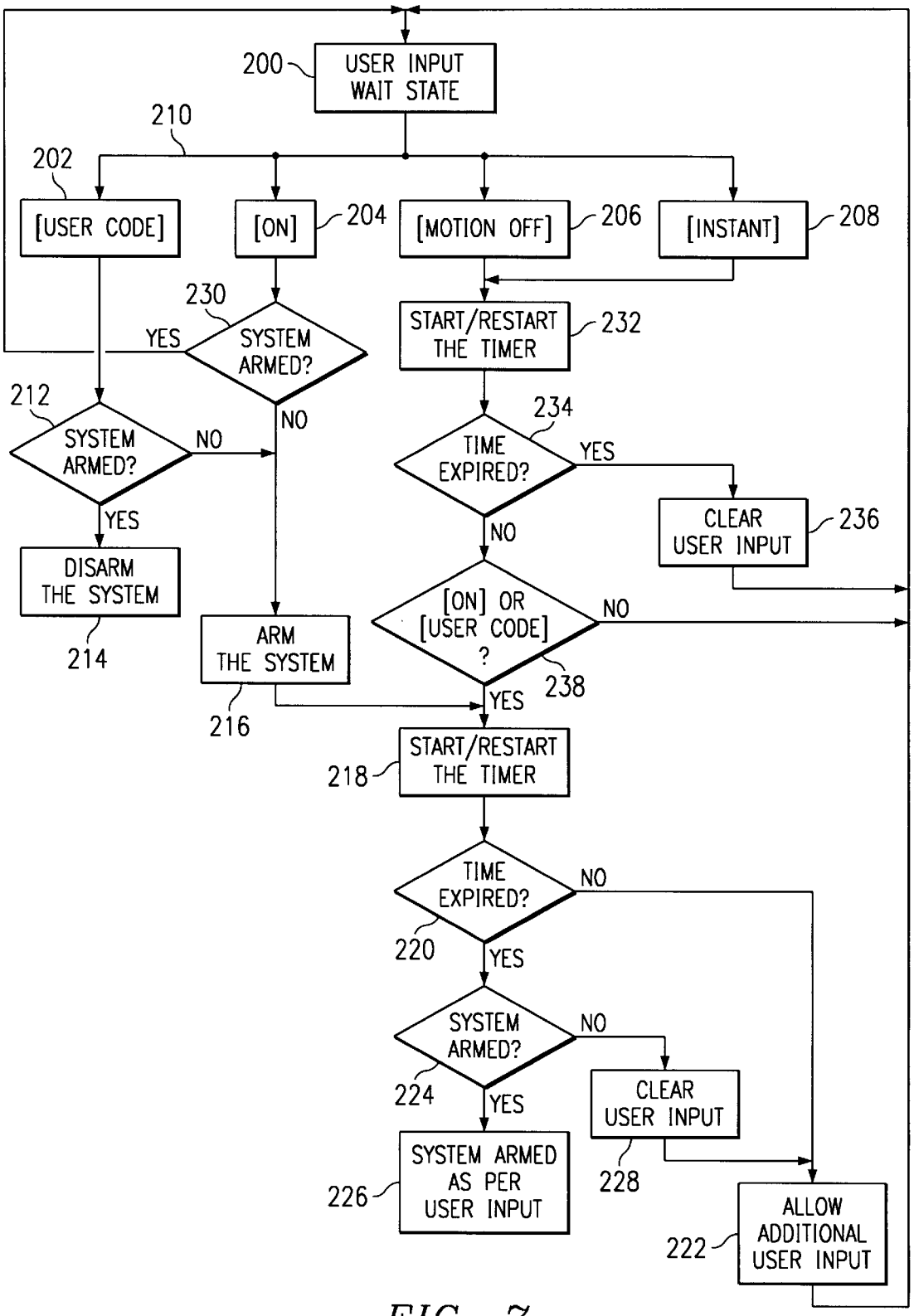
FIG. 7 is a flow diagram illustrating the algorithm for a simple arming of the system.

FIG. 7 is an illustration of the portion of the control system software which allows the user of the security system to arm and disarm the security system in a simple manner. During normal operation, the system waits for input from the user 200. To arm the system, the user may begin with four possible inputs: "[user code]"202; "[ON]" 204; "[MOTION OFF]"206; and "[INSTANT]" 208 (where: "[user code]" is the personal identification number or password which is typically 3 to 4 digits; "[MOTION OFF]" is the motion off function key 15; "[INSTANT]" is the instant function key 16; "[ON]" is the on function key 14). In a true flow chart of the algorithm of this functionality, this would be illustrated as a series of if/then decision blocks, however for simplicity, and because of the limitations of the size of a drawing sheet, a branched line 210 is used to illustrate multiple input possibilities 202, 204, 206 and 208 from the wait state 200. If the user inputs their "user code" 202, and the system is armed 212, then the system is disarmed 214. If the system is not armed, then the system is armed in step 216. After the system is armed 216, a five second timer is set/reset 218 to allow for additional input. After the timer is set 218, the system monitors the clock 220. If the time has not expired the system will accept additional input 222. If it is determined that the time has expired 220, then, if the system is armed, the system remains armed, 224 and 226 respectively. If the system is not armed then the user's input is cleared, 224 and 228 respectively.

If the user inputs [ON] 204 and the system is not armed 230, then the system will be armed 216 and proceed as previously described. If the user inputs [ON] 204 and the system is armed 230, then the system returns to the wait state 200. This configuration ensures that the system can not be reduced from a higher level of security armed status (Ex. Motion Sensors On) to a lower level of security armed status (Ex. Motion Sensors Off) without the user knowing the [user code]. The [user code] must be entered before the system can be rearmed.

If the user inputs [MOTION OFF] 206 or [INSTANT] 208 the timer is started or reset 232. If nothing is input and the time expires 234 then the [MOTION OFF] 206 and/or [INSTANT] 208 inputs are cleared 236 and the system returns to the wait state 200. If either [MOTION OFF] or [INSTANT] are entered and the time has not expired 234 and [ON] or the [user code] have not been entered 238, then the system returns to the wait state 200. Therefore, in order to arm the system either [ON] or the [user code] must be entered in order to arm the system. Since a "motion off" armed status provides a lower level of security than a "motion on" armed status, it is desirable to require the user to enter either the [user code] or [ON] before the system can be armed at the "motion off", lower level of security, armed status.

If [MOTION OFF] 206 or [INSTANT] 208 are entered, and the time has not expired 234, and [ON] or [user code] were entered 238, then the system restarts the timer 218 and proceeds from there as previously described.

Prior art control panels required that the user input a predefined sequence of key strokes. For example, to arm the whole system before going to bed, the user had to press a predefined order of key strokes such as:

[on] [user code] [instant] [on].

If the user decided to get glass of water, watch TV, feed the baby, etc., the whole system had to be disarmed otherwise the motion detectors would trigger an alarm. Disarming the system also required a predefined sequence of key strokes such as:

[on] [user code] [cancel] [on].

If the user of prior art systems wanted all of the system armed except the motion detectors then they had to rearm the system with a different sequence of key strokes:

[on] [user code] [motion off] [instant] [on]

in that order. If the user wanted to turn only the upstairs motion detectors off, the keystrokes became more complicated and the right sequence still had to be followed or the system may not be armed correctly, if at all, and may cause a false alarm.

Figure 8:
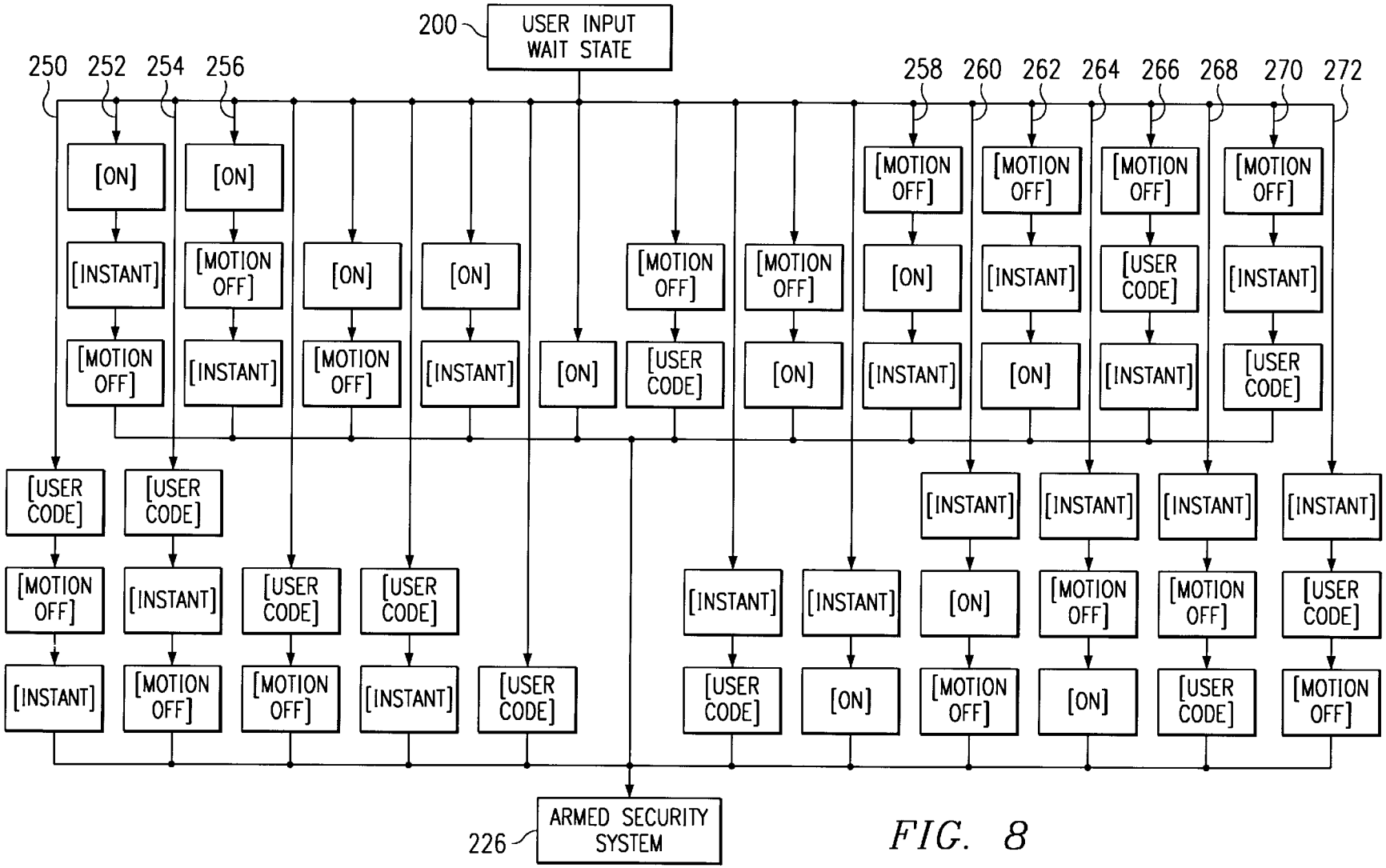
FIG. 8 is a block diagram of the optional key punch sequences for arming the system.

The present control system, described above, allows for greater flexibility for the user to arm, selectively arm, and disarm the security system. The system is not dependent on a particular sequence of key strokes to obtain the desired results. For example if the user wants to arm the whole system except for the motion detectors and without any delay, then he may enter at least 12 different options of key stroke sequences to arm the system to obtain the desired results. The system does require that the time between keystrokes be limited to a predetermined period of time. A suitable time period has been found to be five (5) seconds between key strokes. The optional sequences are illustrated in FIG. 8.

In the left most option 250, the user may input the following keyboard sequence:

[user code] [MOTION OFF] [INSTANT].

But the other sequences of the same key strokes will cause the same result. For example:

option 254 [user code] [INSTANT] [MOTION OFF];

option 270 [MOTION OFF] [INSTANT] [user code]; or option 266 [MOTION OFF] [user code] [INSTANT] and others.

In arming the system it usually is not necessary for the user to know the user code. For this reason, the present invention allows additional flexibility by allowing the [ON] key 14 and the [user code] to be interchangeable when arming the system. Therefore, even more input options for arming are accepted by the system to obtain the same results. For example option 252 [ON] [INSTANT] [MOTION OFF];

option 256 [ON] [MOTION OFF] [INSTANT];

option 258 [MOTION OFF] [ON] [INSTANT]; and others.

Figure 9:
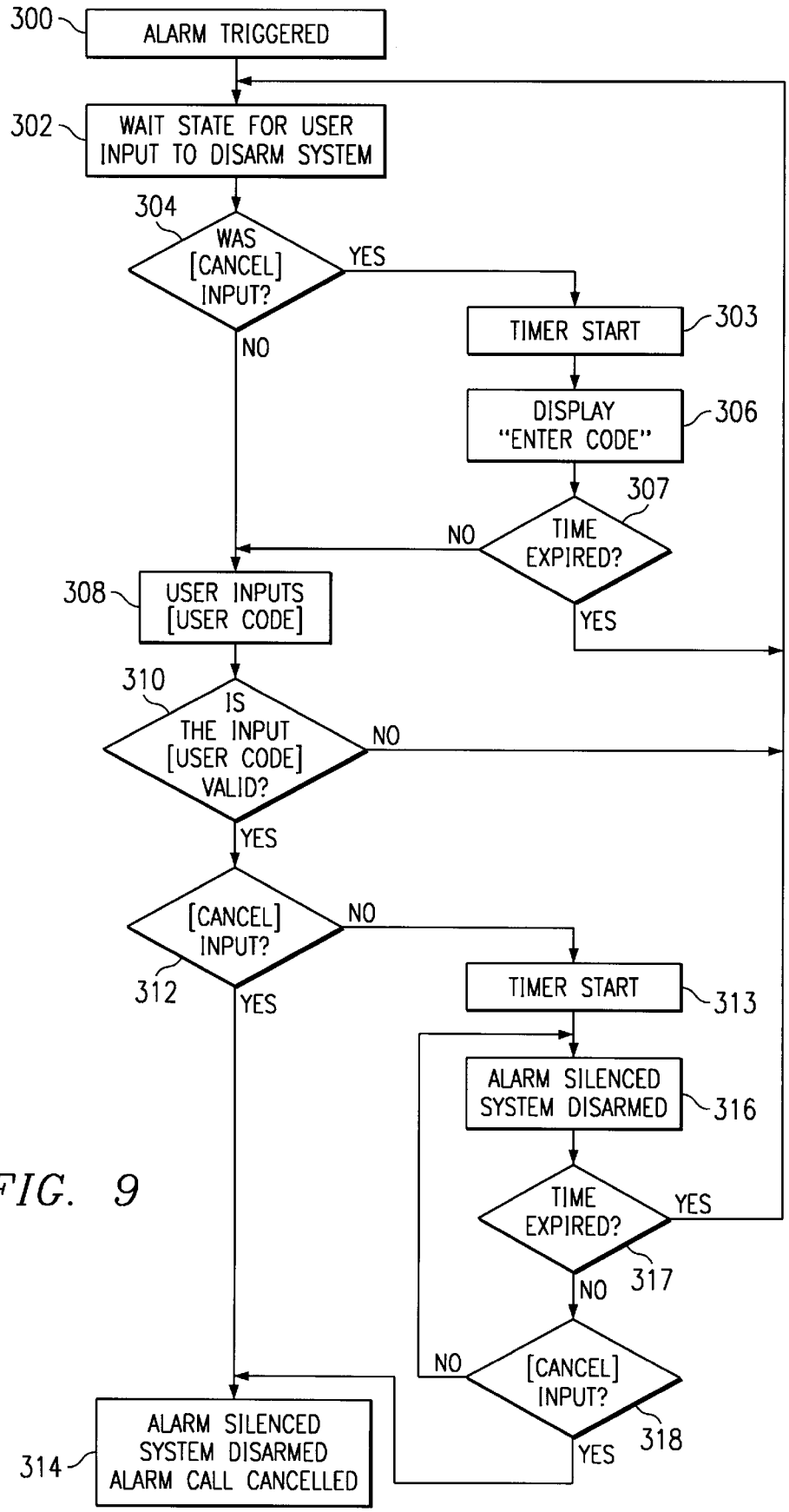
FIG. 9 is a flow diagram illustrating disarming of the security system.

FIG. 9 is an illustration of the algorithm for the user function of disarming, silencing and canceling an alarm. In the preferred embodiment, after an alarm has been triggered 300, a delay clock is set (not shown) to give the user an opportunity to cancel the alarm or disarm the system before the alarm sounds or calls are placed. Twenty seconds is most likely a reasonable delay time period. After an alarm has been triggered 300, the system enters a wait state 302. If [CANCEL] has been input by the user in step 304, then a timer is reset 303 and "ENTER CODE" is displayed 306 on the control panel display to prompt the user to enter the "user code". If the time has expired 307, then the system returns to wait state 302. If the time has not expired 307 and the "user code" is input 308, then the system checks to see if the code is valid 310. If the "user code" entered is invalid 310, then the system returns to a wait state 302. If the entered "user code" is valid 310 and [CANCEL] has been entered 312, then the system is disarmed and the alarm is silenced or does not sound, and the transmission of an alarm to another location is canceled in step 314. If [CANCEL] was not entered 312, then the timer is reset 313 and in the disclosed embodiment, the system will be disarmed, the alarm will be silenced but transmission of the alarm will not be canceled in step 316. If the time has expired 317, then the system returns to wait state 302. If the time has not expired 317 and [CANCEL] has not been entered 318, then the system returns to step 316. If [CANCEL] has been entered 318, then systems alarm call is also canceled 314.

Figure 10:
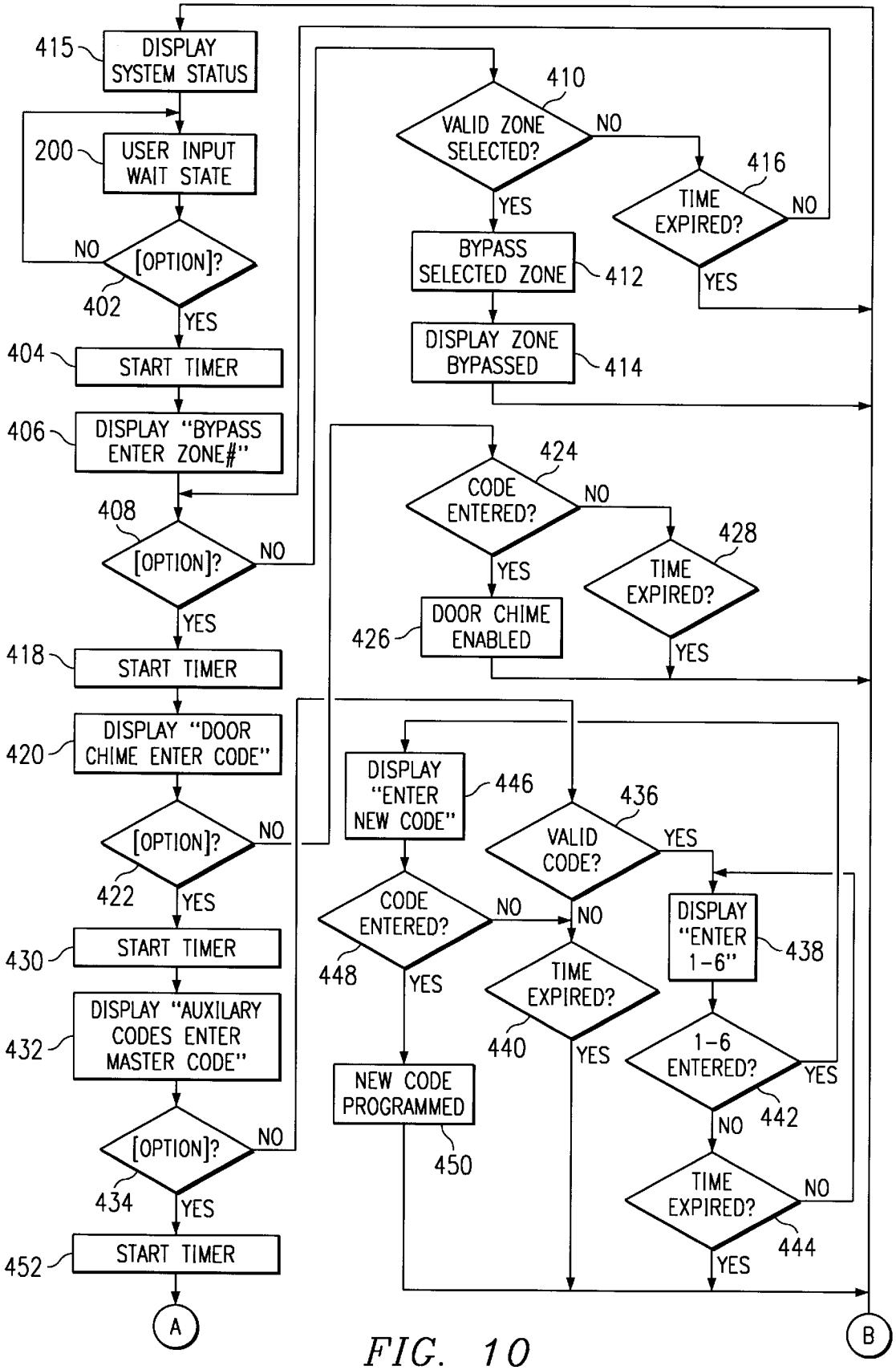
FIG. 10 and FIG. 11 are flow diagram illustrations of the [OPTION] key through which the system can be programmed by the user to, inter alia, selectively arm the system.

FIG. 10 is a flow chart illustrating the portion of the algorithm which allows the user to selectively arm the system through the use of the [OPTION] key. This portion of the algorithm begins in the wait state 200. If the option key is not pressed by the user 402 then the system returns to the wait state 200. If the [OPTION] key is pressed then a timer is started 404. And "BYPASS ENTER ZONE: is displayed 406 to prompt the user to enter a code if they would like to bypass a preprogrammed sensor or zone of sensors. If the option key is not pressed again 408 and a zone is selected 410 by the user, then the zone is bypassed 412 and the bypassed zone is displayed on the display 414 and the system status is displayed 415 and returns to the user input wait state 200.

If the [OPTION] key is not pressed a second time 408 and a valid zone is not selected 410, then after the delay time has expired 416 the system status is displayed 415 and the system returns to the wait state 200. If the [OPTION] key is pressed a second time before the time has expired 408 then the timer is reset 418 and "DOOR CHIME ENTER CODE" is displayed 420 to prompt the user to enable the door chime. If the [OPTION] key is not pressed, a third time 422 and the "user code" is entered 424, then the door chime is enabled 426 and the system displays its status 415 and returns to the wait state 200. If the [OPTION] key is not pressed a third time 422, and a valid code is not entered 424 then after the time has expired 428 the system status is displayed 415 and the system returns to the wait state 200.

If the [OPTION] key is pressed a third time 422 then the timer is reset 430 and "AUXILIARY CODES ENTER MASTER CODE" is displayed 432 to prompt the user that he may reprogram the master code. If the [OPTION] key is not pressed a fourth time 434 and a valid code is not entered 436 and the time expires, 440 then the system status is displayed 415 and returns to the wait state 200.

If a valid code is entered in 436 then "ENTER 1–6" is displayed 438 to prompt the user to enter a number from 1 through 6. If a number from 1 through 6 is not entered 442 then after the time expires 444, the system displays its status 415 and returns to the wait state 200. If a number 1 through 6 is entered 442, then "ENTER NEW CODE" is displayed 446 to prompt the user to enter a new user code. If a new user code is not entered 448, then after the time expires 440 the system status is displayed 415 and it returns to the wait state 200. If a new code is entered 448, then the new valid code is programmed/stored and the system status is displayed and returns to the wait state 200.

Figure 11:
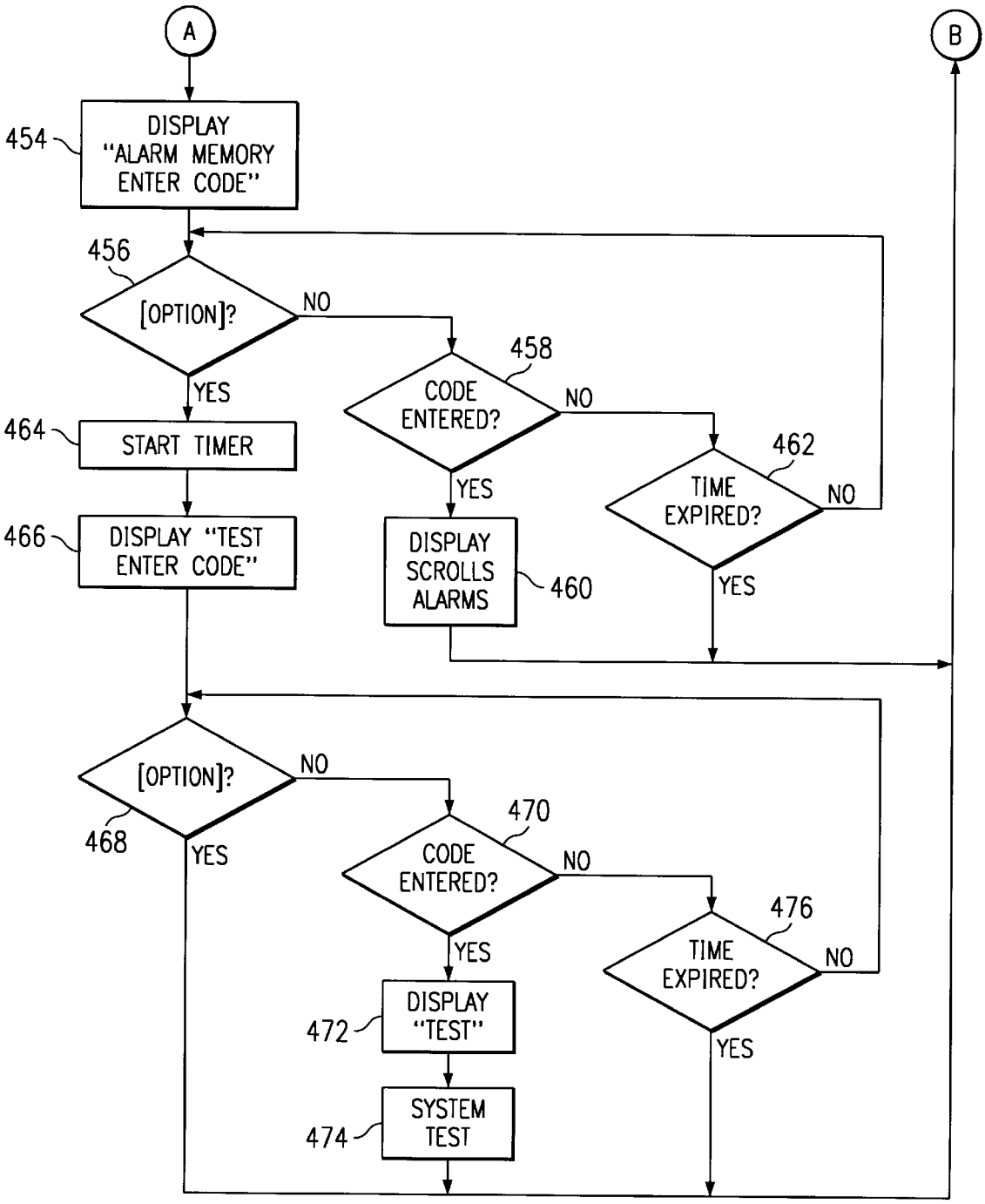

Now referring to FIGS. 10 and 11 concurrently, if the [OPTION] key is pressed a fourth time 434, the timer is restarted 452 and "ALARM MEMORY ENTER CODE" is displayed 454. If the option key is not pressed a fifth time 456, and the user code is entered 458, then the display shows the last alarm triggering event(s) 460, displays the system status 415 and returns to the wait state 200. If the [OPTION] key is not pressed a fifth time 456 and a code is not entered 458, then after the time expires 462 the system status is displayed 415 and returns to wait state 200.

If the [OPTION] key is pressed a fifth time 456, the timer is reset 464 and "TEST ENTER CODE" is displayed 466. If the [OPTION] key is not pressed a sixth time 468 and the user code is entered 470, then "TEST" is displayed 472 and the system tests itself 474, displays the system status 415 and returns to the wait state 200. (Self testing is known in the Art.) If the [OPTION] key is not pressed a sixth time and a code is not entered 470, then after the time expires 476, the system status is displayed 415 and the system returns to the wait state 200. If the [OPTION] key is pressed a sixth time 468, then the system status is displayed 415 and the system returns to the wait state 200.

The illustrations and descriptions of system algorithms, provided herein, are designed to convey to a person reasonably skilled in the art of programming security systems how to implement the invention. The algorithms have been simplified for this purpose. For example, these algorithms do not show, describe or include all of the timing delays for displaying information on the screen. Additionally, a person reasonably skilled in the art will recognize that although the algorithm is shown in parts, herein, in practice these controls will be parts of a whole system.

The disclosure and description of the Invention, provided above and in the drawings, are illustrative and explanatory thereof, and variations in the size, and selection of the hardware and software components and materials as well as details of the illustrated construction are possible without departing from the spirit of the invention.

We claim:

1. A security control system, comprising:

a) sensor devices;

b) an entry keypad comprising both dedicated and numeric keys;

c) a microcontroller; and d) a pseudo alphanumeric display to display system status wherein said pseudo alphanumeric display is not generated by a microcontroller, wherein said pseudo alphanumeric display prompts the user for keypad input to effectuate a desired result;

where the system has a plurality of states, said states corresponding to a system status displayed on said pseudo alphanumeric display, wherein any said state may directly transition to any other said state; and wherein said states comprise an off state, an instant on state, a delayed on state, a motion detect state, a door chime state, a zone on state and a test state.

2. A security control system according to claim 1 wherein said system is armed by path independent key input sequences.

3. A security control system according to claim 1 further comprising a speaker, said speaker providing audible input feedback and system status.

4. A security control system according to claim 1 wherein said dedicated keys include state specific keys and emergency action keys.

* * * * *